US006472834B2

(12) United States Patent
Hiramoto et al.

(10) Patent No.: US 6,472,834 B2
(45) Date of Patent: Oct. 29, 2002

(54) ACCELERATOR AND MEDICAL SYSTEM AND OPERATING METHOD OF THE SAME

(75) Inventors: Kazuo Hiramoto, Hitachiota; Hideaki Nishiuchi, Hitachinaka, both of (JP)

(73) Assignee: Hitachi, Ltd., Tokyo (JP)

( * ) Notice: Subject to any disclaimer, the term of this patent is extended or adjusted under 35 U.S.C. 154(b) by 38 days.

(21) Appl. No.: 09/791,697

(22) Filed: Feb. 26, 2001

(65) Prior Publication Data

US 2002/0014588 A1 Feb. 7, 2002

(30) Foreign Application Priority Data

Jul. 27, 2000 (JP) ..... 2000-231396

(51) Int. Cl.[7] ..... H05H 13/04

(52) U.S. Cl. ..... 315/501; 315/507; 250/492.3; 250/505.1; 250/396 R

(58) Field of Search ..... 315/501, 507, 315/503; 250/492.3, 505.1, 396 R

(56) References Cited

U.S. PATENT DOCUMENTS 5,363,008 A 11/1994 Hiramoto et al. ..... 313/62
5,969,367 A 10/1999 Hiramoto et al. ..... 250/492.3
6,008,499 A * 12/1999 Hiramoto et al. ..... 250/492.3
6,087,670 A * 7/2000 Hiramoto et al. ..... 250/492.3

FOREIGN PATENT DOCUMENTS

| | | |
|---|---|---|
| JP | 07-014699 | 1/1995 |
| JP | 2596292 | 1/1997 |
| JP | 10-118204 | 5/1998 |
| JP | 10-118240 | 5/1998 |

* cited by examiner

*Primary Examiner*—Bruce Anderson
*Assistant Examiner*—Nikita Wells
(74) *Attorney, Agent, or Firm*—Mattingly, Stanger & Malur, P.C.

(57) ABSTRACT

The accelerator is a cyclic type accelerator having deflection electromagnets and four-pole electromagnets for making a charged particle beam circulate, a multi-pole electromagnet for generating a stability limit of resonance of betatron oscillation for the production of the charged particle beam, and a high frequency source for applying a high frequency electromagnetic field to the beam to move the beam to the outside of the stability limit, thus exciting resonance in the betatron oscillation. The high frequency source generates a sum signal of a plurality of AC signals of which the instantaneous frequencies change with respect to time, and of which the average values of the instantaneous frequencies with respect to time are different, and applies the sum signal via electrodes to the beam.

11 Claims, 10 Drawing Sheets

ACCELERATOR AND MEDICAL SYSTEM AND OPERATING METHOD OF THE SAME

BACKGROUND OF THE INVENTION

The present invention relates to an accelerator for accelerating charged-particle beam and producing the beam to be used, a method of producing the beam, and a medical system using the beam.

A conventional accelerator system and method of producing the charged particle beam from the accelerator system are described in JP No. 2,596,292.

As in the publication Ser. No. 2,596,292, the charged particle beam from a preaccelerator is made incident to the following-stage accelerator. The following-stage accelerator accelerates the charged particle beam up to the energy to be necessary for treatment, and produces the beam. The charged particles circulate while vibrating left and right or up and down. There are called betatron oscillations. The number of vibrations per orbit of the betatron oscillation is called tune. Two four-pole electromagnets for convergence and for divergence are used, making the tune close to an integer+⅓ or an integer+⅔ or an integer+½. At the same time, a multiple-pole electromagnet for causing resonance provided on the circular orbit is excited, thereby suddenly increasing the amplitude of the betatron oscillations of the charged particles having more than a certain betatron oscillation amplitude, of a large number of the charged particles that go round. This sudden amplitude increase phenomenon is called resonance of betatron oscillation. The threshold of the amplitude of the betatron oscillations at which the resonance occurs is called stability limit, the value of which changes depending on the relation between the intensities of the resonance generating multi-pole magnetic field and the four-pole magnetic field. The resonance caused when the tune made close to an integer+½ is called second order resonance, and the resonance when the tune made close to an integer+⅓ or+⅔ is called third order resonance. A description will hereinafter be made of a case in which the tune is made close to an integer+⅓ at the third order resonance. The value of the stability limit of resonance decreases as the deviation of tune from an integer+⅓ diminishes. Thus, in the prior art, while the intensity of the resonance generating multi-pole electromagnet is kept constant, the tune is first approached to an integer+⅓, and made constant, namely, the field intensity of the four-pole magnet is maintained constant as well as the intensities of the deflecting electromagnet and resonance generating multi-pole electromagnet are kept constant. Then, a high-frequency electromagnetic field having a plurality of different frequency components or a frequency band is applied to the beam, increasing the betatron oscillation amplitude to generate resonance. The beam is produced from the extracting deflector by making use of the increase of betatron oscillation due to the resonance. The extracted ion beam is transported by use of an electromagnet of an ion beam transport system to a treatment room.

An extracting-purpose high-frequency source used in the conventional accelerator is described in JP-A-7-14,699. The charged particle beam has its tune changed depending on the betatron oscillation amplitude under the action of the resonance generating multi-pole electromagnet. Therefore, the high frequency for beam extraction is required to have a frequency band, or a plurality of different frequency components. In the prior art, such high frequencies, are applied to the charged particle beam, as to have a frequency band of about several tens of kHz including the product of the tune's decimal fraction and revolution frequency of the charged particle beam extracted from the cyclic type accelerator.

The charged particle beam emitted from the accelerator, as described in JP-A-10-118,204, is transported to a treatment room where an irradiator for treatment is provided. The irradiator has a scatterer for increasing the beam diameter, and a beam scanning magnet for making the diameter-increased beam circularly scan. The circular scanning of the beam increased in its diameter by this scatterer acts to flatten the integrated beam intensity inside the locus of the scanning beam center. The beam with the intensity distribution flattened is made coincident in its shape with the diseased part by a patient collimator before being irradiated on the patient.

In addition, though different from the above, a small-diameter beam may be used and scanned for its shape to comply with the diseased part by use of the beam scanning electromagnet. In this small-diameter beam scanning method, the current to the beam scanning electromagnet is controlled to irradiate the beam at a predetermined position. The high frequencies are stopped from being applied to the beam after confirming the application of a certain amount of irradiation by a beam intensity monitor, thus the beam being stopped from emission. After the stopping of beam irradiation, the current to the beam scanning electromagnet is changed to change the irradiation position, and the beam is again irradiated in a repeating manner.

Thus, in the conventional medical accelerator system, before being irradiated, the beam is increased in its diameter by the scatterer and circularly deflected to scan so that the integrated intensity distribution in the region inside the scan circle can be flattened. In this beam scanning irradiation, to flatten the intensity distribution, it is desired to reduce the change of the beam intensity, and particularly to decrease the frequency components ranging from about tens of Hz to tens of kHz. However, in the conventional medical accelerator system, since the high frequencies to be applied to the charged particle beam have a frequency band, or a plurality of different frequencies for the emission, the beam emitted from the accelerator has frequency components ranging from about tens of Hz to tens of kHz, and the intensity thereof is changed with lapse of time. Therefore, in order to obtain a uniform irradiation intensity distribution, it is necessary to properly select the circular scanning speed according to the change of beam intensity with time, or to flatten the irradiation intensity distribution by selecting a scanning frequency deviated from the frequency of the beam intensity change. The beam intensity change problem can be solved by much increasing the circular scanning frequency, but the cost of the scanning electromagnets and power supply is greatly increased. Moreover, when the beam intensity change with time is great, the conditions such as reproducibility and stability of the current to the scanning electromagnet, which are necessary to suppress the change of the irradiation field intensity distribution to within an allowable range, are severer than in the case where the beam intensity change with time is small.

Moreover, in the prior art, even though the canning beam diameter is large or small, the beam intensity change with time makes it necessary to increase the time resolution of the beam intensity monitor to confirm a predetermined irradiation intensity distribution.

SUMMARY OF THE INVENTION

Accordingly, it is an object of the invention to provide an accelerator capable of suppressing the change of the emitted beam current of, particularly, frequencies from about tens of Hz to tens of kHz, a medical accelerator system using that accelerator and a method of operating the system.

According to one aspect of the invention to achieve the above object, there is provided a circular type accelerator having deflecting electromagnets and four-pole electromagnets for making a charged particle beam circulate, a multi-pole electromagnet for generating a stability limit of resonance of betatron oscillation in order to produce the charged particle beam, and a high-frequency source for applying a high-frequency electromagnetic field to the charged particle beam to move the charged particle beam to the outside of the stability limit and thereby to excite resonance in the betatron oscillation, characterized in that the high-frequency source generates an AC signal that includes a plurality of different frequency components, the minimum frequency difference of which is in the range from 500 Hz to 10 kHz and, the phases of which include the phase difference between those frequency components and values other than an integer$\times\pi$.

In order to increase the betatron oscillation amplitude of the charged particle beam by high frequencies to shift it to the outside of the stability limit, it is desired that the high frequencies be close to the product of the decimal fraction of the tune (the number of betatron oscillations during the time in which the charged particle beam once circulates in the cyclic type accelerator) of the charged particle beam, and the circulation frequency, or to the product of the decimal fraction of the tune and an integral multiple of the circulation frequency. The tune is changed depending on the amplitude of the betatron oscillation. Thus, in order to exceed the stability limit for irradiation, and hence to increase the amplitude of betatron oscillation, it is necessary to use high frequencies having a plurality of different frequency components.

In the above aspect of the invention, since an AC signal that includes a plurality of different frequency components of which the minimum frequency difference is in the range from 500 Hz to 10 kHz is applied to the charged particle beam from the high-frequency source, the lowest frequency component of the change of the betatron oscillation amplitude of the charged particle beam is in the range from 500 Hz to 10 kHz, and thus it is possible to exclude the change of the irradiation current below some hundreds of Hz that is particularly necessary to be suppressed in the irradiation method in which a small-diameter beam is deflected to scan. In addition, if the phase difference between the frequency components is an integer$\times\pi$, the signal intensity is greatly increased or decreased due to the superimposition of those different frequency components. However, by selecting the phase difference between those frequency components to be a value other than an integer$\times\pi$, it is possible to suppress the emitted beam intensity from changing.

In order to achieve the above object, according to another aspect of the invention, there is provided a cyclic type accelerator having deflecting electromagnets and four-pole electromagnets for making a charged particle beam circulate, a multi-pole electromagnet for generating a stability limit of betatron oscillation resonance for producing the charged particle beam, and a high-frequency source for applying a high-frequency electromagnetic field to the charged particle beam to shift it to the outside of the stability limit and to excite resonance in the betatron oscillation, characterized in that the high-frequency source generates the sum of a plurality of AC signals of which the instantaneous frequencies change with time and of which the average values of the instantaneous frequencies with respect to time are different, and applies the sum signal to the charged particle beam.

When a high-frequency signal having a plurality of frequency components is applied to the charged particle beam, the charged particle beam undergoes the betatron oscillation that has a betatron oscillation frequency (the product of the revolution frequency and tune of the charged particle beam) depending on the intensities of the electromagnets of the accelerator, and the high frequency components applied for emission, and the amplitude of the betatron oscillation is changed at the sum and differences between the betatron oscillation frequency and the high frequency components applied for emission, and at the sums and differences of those high frequency components themselves. As a result, the number of particles of the charged particle beam or the intensity of the emitted charged particle beam, that exceeds the stability limit, is also changed at the same frequencies as above. The frequency components of some tens of kHz or below that are important in the application of the charged particle beam to medical treatment are produced due to the differences between the betatron oscillation frequency and the high frequency components applied for emission, and the differences between those high frequency components for emission. The change of the emitted beam of some tens of kHz or below with time can be reduced on the principle according to the above features of the invention as described below.

The AC signal is expressed by $A_i \sin(2\pi f_i t+\theta_i)$ where t is time, $A_i$ the amplitude, and $\theta_i$ the phase, and the instantaneous frequency by $f_i+(d\theta_i/dt)/(2\pi)$. When the instantaneous frequency changes with time, then $d\theta_i/dt\neq 0$. When the average value of $d\theta_i/dt$ is previously determined to be zero, the average value of the instantaneous frequency with respect to time is $f_i$. The betatron oscillation amplitude of the charged particle beam is changed at the frequency difference between the betatron oscillation frequency and the applied high frequency. According to the above feature, the sum signal, $\Sigma A_i \sin(2\pi f_i t+\theta_i(t))$, of AC signals that have different frequencies $f_i$ (i=1, 2 . . . n, where n is 2 or above), and phases $\theta_i$ changing with time, is generated and applied to the charged particle beam.

The betatron oscillation amplitude of the charged particle beam is changed at the difference frequency between the betatron oscillation frequency and the applied high frequency. The betatron oscillation amplitude changes at frequency of $f_i-f_\beta$ due to the applied high frequency of $f_i$. Since the phase $\theta_i$ of the AC signal of frequency $f_i$ changes with time, the phase of the amplitude change of the betatron oscillation at frequency $f_i-f_\beta$ also depends on the circulation position of the charged particle beam that circulates in the accelerator, that is, on the back-and-forth positions of the beam. As a result, whether the beam is emitted or not depends on the circulation position of the beam that circulates in the accelerator, or on the back-and-forth positions. The direction and position of which the beam that circulates in the accelerator and emitted therefrom are changed at each revolution. In other words, at a certain time, the head of the charged particle beam in the turning direction is emitted, but the second half of the beam from its center in the rotating direction is not emitted. However, as time elapses, the central portion of the beam in the turning direction is emitted, but the first and second halves of the beam in the rotating direction are not emitted. Thus, the betatron oscillation amplitude increases at a different phase depending on the circulation position, and the beam is emitted at a circular position that changes with time. In the prior art, the beam is emitted at all circular positions and similarly less emitted at all circular positions. Therefore, in the invention, the change of all charged particles of the beam with respect to time is extremely small.

According to still another aspect of the invention, there is provided a cyclic type accelerator having deflection electromagnets and four-pole electromagnets for deflecting the charged particle beam to turn, a multi-pole electromagnet for generating a stability limit of resonance of betatron oscillation for the emission of the beam, and a high-frequency source for applying a high-frequency electromagnetic field to the beam to shift it to the outside of the stability limit and hence to excite resonance in betatron oscillation, characterized in that the high-frequency source generates a sum signal of a plurality of different signals whose instantaneous frequencies change with respect to time, and which have average values of the instantaneous frequencies with respect to time, and differences between the instantaneous frequencies and the average values of the instantaneous frequencies with respect to time, and that it applies the sum signal to the beam.

The AC signal is expressed by $A_i \sin(2\pi f_i t+\theta_i)$ where t is time, $A_i$ the amplitude, and $\theta_i$ the phase, and the instantaneous frequency by $f_i+(d\theta_i/dt)/(2\pi)$. When the instantaneous frequency changes with time, $d\theta_i/dt\neq 0$. When the average value of $d\theta_i/dt$ is previously determined to be zero, the average value of the instantaneous frequency with respect to time is $f_i$. According to the above feature, the sum signal, $\Sigma A_i \sin(2\pi f_i t+\theta_i(t))$, of AC signals of which the $(d\theta_i/dt)$, $(d\theta_j/dt)$ $(i\neq j)$ are different, or rates of change of phases $\theta_i$ and $\theta_j$ are different at $f_i$ (i=1, 2, . . . n, where n is 2 or above), is generated and applied to the charged particle beam.

The betatron oscillation amplitude of the charged particle beam is changed at the frequency difference between the applied high frequencies. In other words, when the applied frequencies are represented by $f_i$ and $f_j$, the betatron oscillation amplitude is changed at the difference $f_i-f_j$. Also, the phases $\theta_i$ and θj of AC signals of the frequencies $f_i$ and $f_j$ are changed at different rates with respect to time, and thus the change of the betatron oscillation amplitude at frequency $f_i-f_j$ depends on the circulation position, or phase of the beam that circulates in the accelerator, or on the back-and-forth position of the beam. Thus, since the phase of the increase of the betatron oscillation amplitude depends on the circulation position of the beam, and since the phases change, the number of all charged particles of the beam produced is much less changed with respect to time as in claim 1 of the invention.

According to another aspect of the invention, there is provided a cyclic type accelerator having deflection electromagnets and four-pole electromagnets for making a charged particle beam circulate, a multi-pole electromagnet for generating a stability limit of resonance of betatron oscillation for irradiation of the beam, and a high frequency source for applying a high frequency electromagnetic field to the beam to move the beam to the outside of the stability limit, thus exciting resonance in the betatron oscillation, characterized in that the high frequency source generates a sum signal, $\Sigma A_i \sin(2\pi f_i t+\theta_i)$where t is time, of a plurality of AC signals that have different frequencies $f_i$, and phases $\theta_i$ and amplitude $A_i$ associated with frequencies $f_i$, the phases $\theta_i$ being changed with a predetermined period.

The AC signals are represented by $A_i \sin(2\pi f_i t+\theta_i)$ where t is time, and $A_i$ is the amplitude. The instantaneous frequency is expressed by $2\pi f_i+d\theta_i/dt$. Therefore, when $\theta_i$ associated with each $f_i$ is changed with a predetermined period as in the characterized-in-that paragraph of the above aspect of the invention, the phase of the increase of the betatron oscillation for irradiation is also changed every second as in the accelerator of claim 1. Thus, the intensity of the produced beam is averaged, with the result that the beam is less changed with respect to time.

According to still another aspect of the invention, there is provided a cyclic type accelerator having deflection electromagnets and four-pole electromagnets for making a charged particle beam circulate, a multi-pole electromagnet for generating a stability limit of resonance of betatron oscillation for irradiation of the beam, and a high frequency source for applying a high frequency electromagnetic field to the beam to move the beam to the outside of the stability limit, thus exciting resonance in the betatron oscillation, characterized in that the high frequency source has a plurality of thermal noise generators, and switching means provided at the stage next to those thermal noise generators in order to select one of the outputs from those generators at predetermined intervals of time, and applies to the beam a high frequency based on the output from the selected thermal noise generator.

Thus, the phase difference between different high frequencies to be applied to the beam is changed with a predetermined period. As a result, the phase of the betatron oscillation amplitude change is changed every second, and hence the produced beam intensity is averaged so that the beam intensity is less changed.

According to another aspect of the invention, there is provided a medical accelerator system having a cyclic type accelerator, a transport system for transporting a charged particle beam produced from the cyclic type accelerator, and an irradiator for irradiating the beam on patient, characterized by the use of the cyclic type accelerator claimed in claim 1 for the accelerator.

Thus, the low frequency components of the amplitude change of the betatron oscillation within the cyclic type accelerator are reduced with the result that the produced beam is less changed with respect to time. Therefore, the beam with its amplitude less changed can be irradiated from the irradiator for treatment.

According to another aspect of the invention, there is provided a medical accelerator system having a cyclic type accelerator, a transport system for transporting a charged particle beam generated from the accelerator, and an irradiator for irradiating the beam on patient, characterized by the use of the cyclic type accelerator claimed in claim 2 for the accelerator.

Thus, the phase of the amplitude change of the betatron oscillation within the cyclic type accelerator is also changed every second, and the generated beam intensity is averaged with the result that the produced beam is less changed with respect to time. Therefore, the beam with its amplitude less changed can be irradiated from the irradiator for treatment.

According to still another aspect of the invention, there is provided a medical accelerator system having a cyclic type accelerator, a transport system for transporting a charged particle beam generated from the accelerator, and an irradiator for irradiating the transported beam on patient, characterized by the use of the cyclic type oscillator claimed in claim 4 for the accelerator.

Thus, the phase of the high frequency to be applied to the beam in order that the beam can be generated from the accelerator is changed with respect to time. Consequently, the phase of the amplitude change of the betatron oscillation is also changed every second, and the produced beam intensity is averaged with the result that the generated beam intensity is less changed with respect to time. Therefore, the beam with its intensity less changed can be irradiated from the irradiator for treatment.

According to another aspect of the invention, there is provided a method of operating a medical accelerator system that has a cyclic type accelerator including deflection electromagnets and four-pole electromagnets for making a charged particle beam circulate, a multi-pole electromagnet for generating a stability limit of resonance of betatron oscillation for irradiation of the charged particle beam, and a high frequency source for applying a high frequency electromagnetic field to the beam to move the beam to the outside of the stability limit, thus exciting resonance in the betatron oscillation; a transport system for transporting the beam produced from the cyclic type accelerator; and an irradiator for irradiating the transported beam on patient, the method comprising the steps of generating from the high frequency source an AC signal for moving the beam to the outside of the stability limit and that includes a plurality of frequency components, between which the minimum frequency difference is in the range from 500 Hz to 10 kHz inclusive, and of which the phases include phase differences between the frequency components and values other than an integer×π, applying the AC signal to the beam so that the beam can be generated from the cyclic type accelerator, and irradiating the beam from the irradiator for treatment.

Thus, the low frequency components of the amplitude change of the betatron oscillation within the cyclic type accelerator are reduced, and the produced beam intensity is less changed with respect to time with the result that the beam with its intensity less changed with respect to time can be produced from the accelerator. Therefore, the beam with its amplitude less changed can be irradiated from the irradiator for treatment. Particularly, it is possible to reduce the change of the irradiation current below some hundreds of Hz that is necessary to be suppressed in a small-diameter beam scanning irradiation method.

According to still another aspect of the invention, there is provided a method of operating a medical accelerator system that has a cyclic type accelerator including deflection electromagnets and four-pole electromagnets for making a charged particle beam circulate, a multi-pole electromagnet for generating a stability limit of resonance of betatron oscillation for irradiation of the charged particle beam, and a high frequency source for applying a high frequency electromagnetic field to the beam to move the beam to the outside of the stability limit, thus exciting resonance in the betatron oscillation; a transport system for transporting the beam produced from the cyclic type accelerator; and an irradiator for irradiating the transported beam on patient, the method comprising the steps of generating from the high frequency source a sum signal of a plurality of signals of which the instantaneous frequencies change with respect to time, and of which the average values of the instantaneous frequencies with respect to time are different, applying the sum signal to the beam so that the beam can be produced from the cyclic type accelerator, and irradiating the beam from the irradiator for treatment.

Thus, the phases of a plurality of high frequency components to be applied to the beam in order that the beam can be produced from the accelerator are changed with respect to time. Consequently, the phase of the amplitude change of the betatron oscillation is also changed every second, and the produced beam intensity is averaged so that the beam with its intensity less changed can be generated. Therefore, the beam with its intensity less changed can be irradiated from the irradiator for treatment.

According to further aspect of the invention, there is provided a method of operating a medical accelerator system that has a cyclic type accelerator including deflection electromagnets and four-pole electromagnets for making a charged particle beam circulate, a multi-pole electromagnet for generating a stability limit of resonance of betatron oscillation for irradiation of the charged particle beam, and a high frequency source for applying a high frequency electromagnetic field to the beam to move the beam to the outside of the stability limit, thus exciting resonance in the betatron oscillation; a transport system for transporting the beam produced from the cyclic type accelerator; and an irradiator for irradiating the transported beam on patient, the method comprising the steps of applying to the beam a sum signal, $\Sigma A_i \sin(2\pi f_i t+\theta_i)$where t is time, of a plurality of AC signals that have different high frequencies $f_i$ (i=1, 2 . . . n), and phases $\theta_i$ and amplitudes $A_i$ associated with the frequencies $f_i$, the phases $\theta_i$ changing with a predetermined period with respect to time, transporting the beam produced from the accelerator by applying the high frequency signal to the beam, and irradiating the beam from the irradiator.

Thus, the phases of a plurality of high frequencies applied to the beam in order that the beam can be generated from the accelerator are changed at predetermined intervals of time. Consequently, the phase of the amplitude change of the betatron oscillation is changed every second, and the produced beam intensity is averaged with the result that the produced beam intensity is less changed with respect to time. Therefore, the beam with its intensity less changed can be irradiated from the irradiator for treatment.

DESCRIPTION OF THE EMBODIMENTS

Embodiment 1

A medical accelerator system of the first embodiment according to the invention will be described with reference to FIG. 1.

Figure 1:
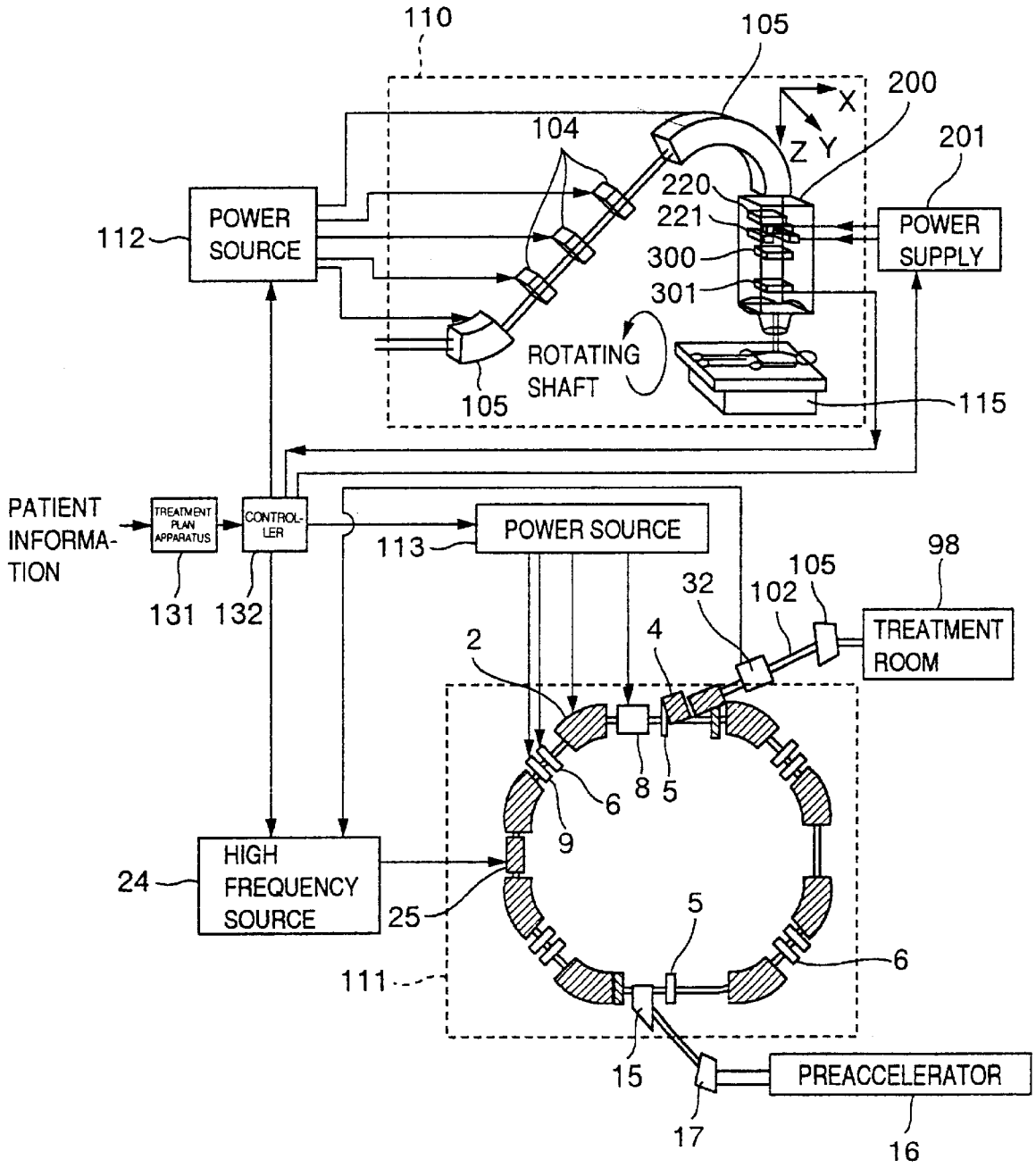
FIG. 1 is a diagram of a medical accelerator system of one embodiment according to the invention.

FIG. 1 shows the first embodiment of a medical accelerator system according to the invention. In this system, protons are injected and extracted, and the beam produced from the accelerator 111 is transported to a treatment room 98 in order to give someone treatment for cancer. For treatment, a treatment plan apparatus 131 is used to determine beam energy, beam radiation dosage, and beam irradiation time on the basis of patient information, and transmit them to a controller 132. The controller 132 controls, according to those information, a power supply 113 for each device of accelerator 111, a power supply 112 for devices of an emitted-beam transport system, and a power supply 201 for an irradiator 200 of a treatment irradiator system.

The accelerator 111 according to the invention includes a preaccelerator 16, an incident beam transport system 17 for transporting the beam to the accelerator 111, an entrance device 15, a high frequency acceleration cavity 8 for giving incident beam energy, a deflection electromagnet 2 for bending the beam orbit, four-pole electromagnets 5, 6 for controlling the betatron oscillation of the beam, a six-pole electromagnet 9 for exciting the resonance at the time of emission, electrodes 25 for applying a changing-with-time high frequency electromagnetic field to the beam in order to increase the betatron oscillation amplitude of particles within a stability limit of resonance, and a beam ejecting device 4 for supplying the amplitude-increased particles to a beam transport system 102. The beam transport system 102 is formed of deflection electromagnets 105 and four-pole electromagnets 104. Of those devices, the six-pole electromagnet 9 for resonance generation, the electrodes 25 for giving the beam a high frequency electromagnetic field, the beam output device 4, and the four-pole electromagnets 104 and deflection electromagnets 105 of the beam transport system are used only for the process to emit the accelerated beam.

The beam incident to the accelerator via the entrance device 15 is bent in its orbit by deflection electromagnets 2 in the course of going round. In addition, the beam is rotated along the designed orbit while undergoing betatron oscillation under the action of the four-pole electromagnets. The frequency of the betatron oscillation can be controlled by changing the amounts of exciting the four-pole electromagnets 5 for convergence and four-pole electromagnets 6 for divergence. In order to stably make the incident beam circulate in the accelerator 111, it is necessary for the number of betatron vibrations per full circle of the accelerator, or betatron frequency (tune) not to cause resonance. In this embodiment, the four-pole electromagnets 5, 6 are adjusted so that the horizontal tune νx and vertical tune νy can be approached to a value of an integer+0.25 or an integer+0.75. Under this condition, the beam can be stably circulated within the accelerator, and given energy from the high frequency acceleration cavity 8 in the course of circulation. The beam is further accelerated by increasing the magnetic field intensities of the deflection electromagnet 2 and four-pole electromagnets 5, 6 while the field intensity ratio of the magnets is being kept constant. Since the ratio of the field intensities is constant, the number of betatron vibrations per full circle of accelerator, or tune can be maintained constant.

In the extraction process, the power source to the four-pole electromagnets 5 for convergence and the power source to the four-pole electromagnets 6 for divergence are adjusted so that the horizontal tune νx can have a value of an integer+⅓+Δ or an integer+⅔+Δ (where Δ is as small as about 0.01). In the following description, the horizontal tune νx is selected to be an integer+⅓+Δ. Then, current for resonance excitation is caused to flow in the six-pole electromagnet 9. The intensity of the current flowing in the six-pole electromagnet 9 is determined so that the particles having large betatron oscillation amplitudes, of the circulating beam, can be fallen within a stability limit. The value of the current intensity is previously estimated by computation or through repeated irradiation operations.

Figure 3:
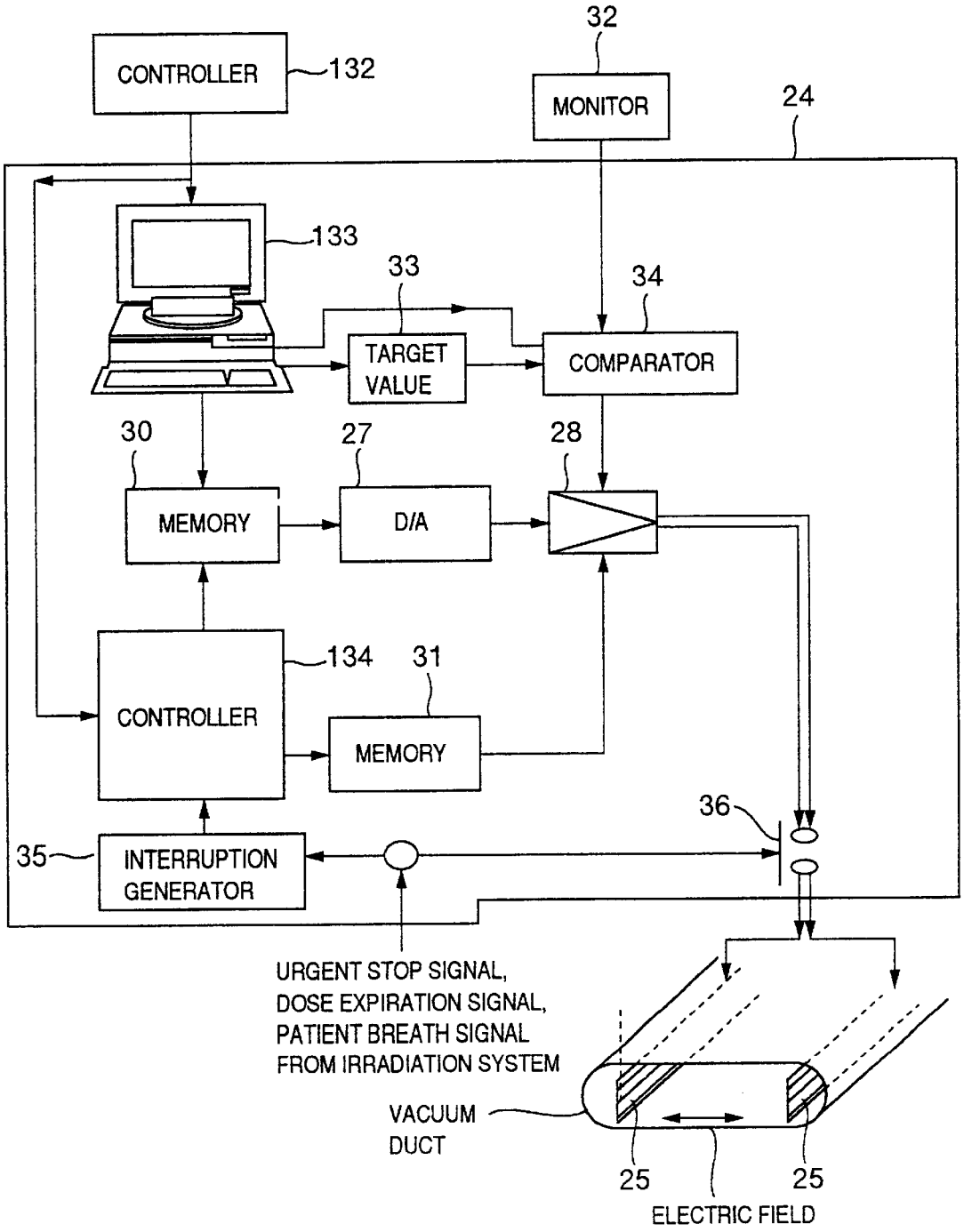
FIG. 3 is a diagram of high-frequency source 24 in FIG. 1.

Then, the high frequency signal generated from the high frequency source 24 is applied to the beam via the electrodes 25. FIG. 3 is a block diagram of the high frequency source 24. As illustrated in FIG. 3, the electrodes 25 are plate-like electrodes, and opposed to each other in the horizontal direction so that a signal changing with respect to time can be applied to the beam. Currents of opposite signs are supplied from the high frequency source 24 to the electrodes 25, thus producing electric fields in the directions shown in FIG. 3, by which the charge particle beam is affected.

The high frequency source 24 shown in FIG. 3 receives signals of beam energy E, cyclic frequency $f_r$, taking-out time $t_{ex}$, and target irradiation dose that the controller 132 has supplied according to the information from the treatment plan apparatus 131, and applies to the electrodes 25 the following signal changing with respect to time. That is, the high frequency source 24, on the basis of the signals from the controller 132, generates a sum signal, $\Sigma A_i \sin(2\pi f_i t+\theta_i)$, where t is time, of AC signals that have different frequencies $f_1, f_2, \ldots f_n$ ($f_1<f_2<\ldots<f_n$), and phases $\theta_i$ (i=1, 2 . . . n) and amplitudes $A_i$ (i=1, 2, . . . n) associated with frequencies $f_i$ (i=1, 2 . . . n) and of which the instantaneous frequencies are changed with respect to time. In other words, the phases $\theta_i$ of the AC signals are repeatedly changed at predetermined intervals of time, and the sum signal is applied to the electrodes 25. The change of phase $\theta_i$ with respect to time is selected so that phases $\theta_i$, $\theta_j$, $\theta_i-\theta_j$ of $\theta_i$, $\theta_j$ ($i\neq j$, i, j=1, 2, . . . n) can be changed with a certain period. A plurality of frequencies $f_i, f_2, \ldots f_n$ include values of $f_r/3$ through $(⅓+\delta)f_r$ based on the cyclic frequency $f_r$, between the minimum and maximum values. The frequencies $f_1, f_2, \ldots f_n$ are selected so that the difference between the frequency $f_{i+1}$ and the adjacent frequency $f_i$ is in the range from 1 kHz to 10 kHz. The reason for the selection of those frequency components is based on the following considerations.

(a) The tune of the beam having an extremely small betatron oscillation amplitude is an integer+⅓+δ as determined by the four-pole electromagnets. However, the tune of the particles of which the betatron oscillation amplitude is as large as close to the stability limit is deviated about δ from this value to be close to a value of an integer+⅓. Thus, the tunes of the beam particles of which the oscillation amplitudes are between those values are continuously distributed between the values of an integer+⅓+δ and an integer+⅓.

(b) In order to effectively increase the betatron oscillation amplitude of the charged particle beam, it is necessary that a high frequency close to the betatron oscillation frequency be applied to the charged particle beam.

(c) The betatron oscillation amplitude of the charged particle beam is changed at the frequency differences $f_i-f_j$ (i, j=1, 2 . . . n) between the high frequencies $f_i$, $f_2, \ldots f_n$, and thus the beam current is changed at the the same frequencies. Therefore, the frequency $f_i$ (i=1, 2 . . . n) is determined so that the frequency difference, $f_{i+1}-f_i$ is equal to or higher than 500 Hz which if desired in the small-diameter beam scanning. When the frequency difference $f_{i+1}-f_i$ is selected to be 10 kHz or above, it is difficult to effectively increase the betatron oscillation amplitude by high frequencies with a practical power.

When secondary resonance is used for betatron oscillation resonance, the tune is selected to be close to an integer+½. The frequency band width is the same as above.

The phase $\theta_i$ (i=1, 2 . . . n) of the signal $A_i \sin(2\pi f_i t+\theta_i)$ at frequency $f_i$ is changed m times (m: an integer) as $\theta_1$, $\theta_2$, . . . $\theta_m$ at intervals of time $\Delta t$. After changing m times, the same phase change is repeated with a period of $T_{exrf}=m\Delta t$.

Figure 4:
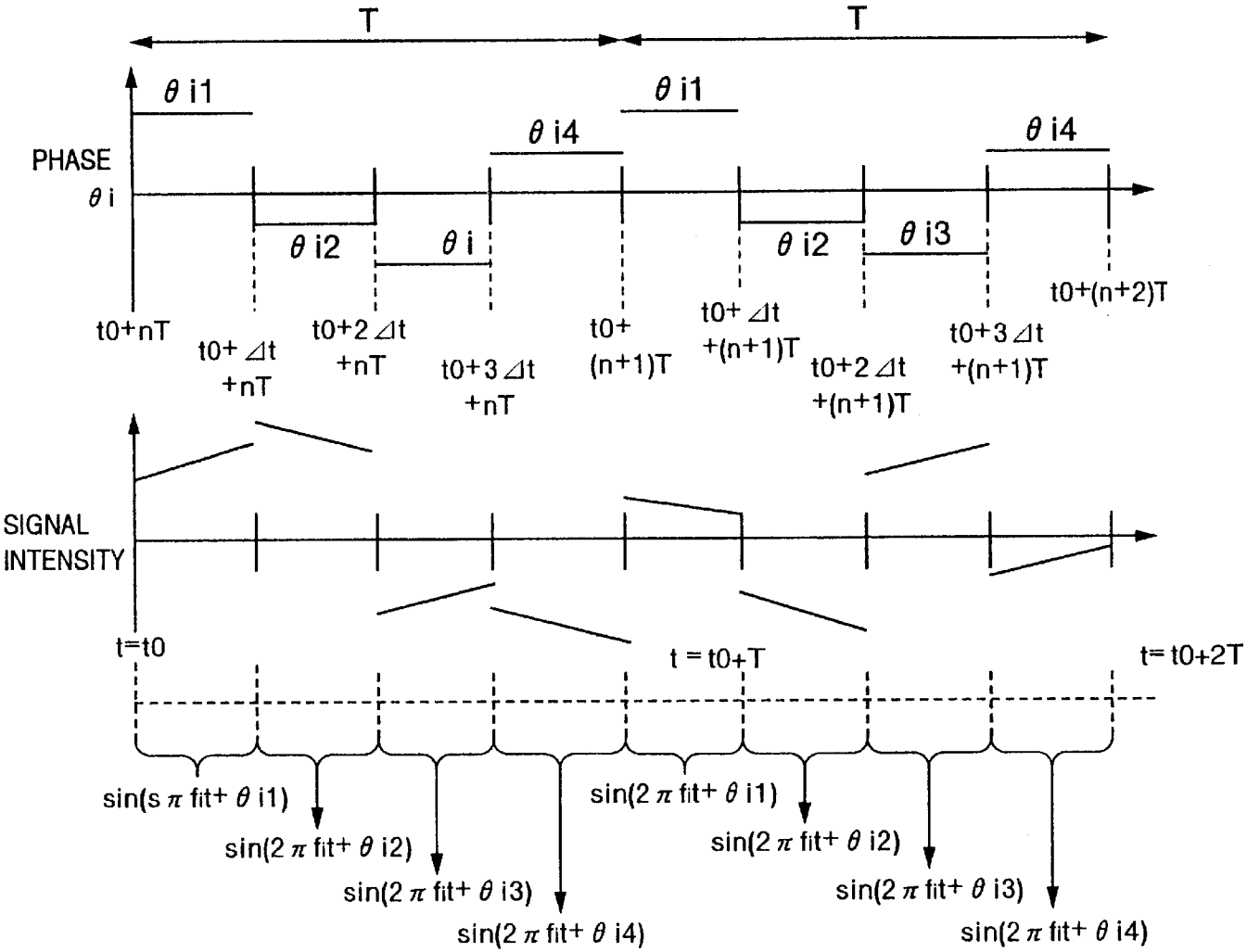
FIG. 4 is a diagram showing the change of phase and signal intensity of a high-frequency signal applied to the electrodes 25.
Figure 5:
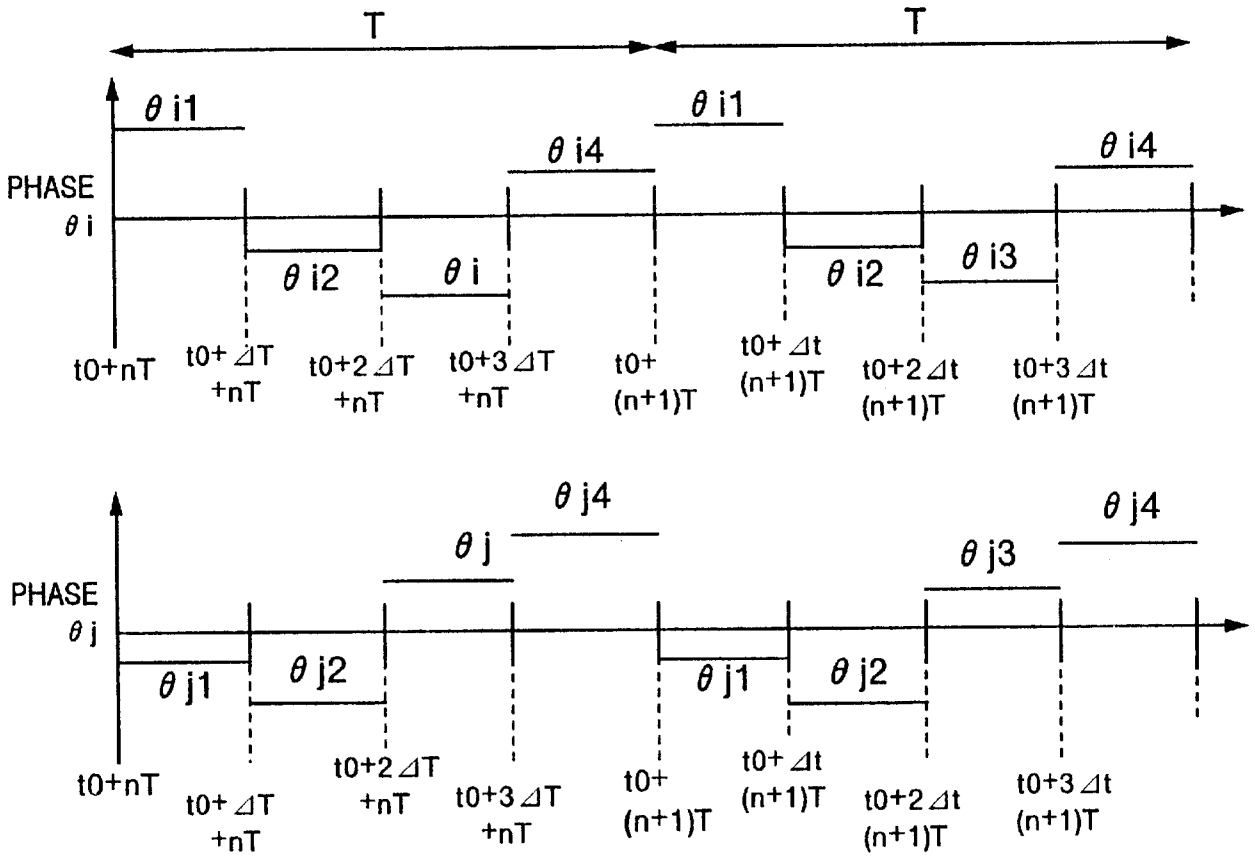
FIG. 5 is a diagram showing the change of phase of a high-frequency signal applied to the electrode.

Although the period $T_{exrf}$ will be described later, this embodiment employs the period $T_{exrf}$ with which the phase is changed, as the cyclic period T (=1/$f_r$) of the beam accelerator, and the number of divisions m is selected as m=4. FIG. 4 shows the changes of phase $\theta_i$ of the signal frequency $f_i$, and the signal intensity of frequency $f_i$ (i=1, 2 . . . n). The period, T in FIG. 4 corresponds to $T_{exrf}$. The phase of each frequency $f_i$ at time $t_0+kT_{exrf}$ (k: an integer) is $\theta_{i1}$, and after the lapse of time $\Delta t$, or at time $t=t_0+\Delta t+kT_{exrf}$, the phase is changed to $\theta_{i2}$. This phase change is made for each frequency $f_i$. Similarly, the phase is changed to initial phase $\theta_{i3}$ at time $t=t_0+2\Delta t+kT_{exrf}$, and to phase $\theta_{i4}$ at time $t=t_0+3\Delta t+kT_{exrf}$. When m>4, the phase is further changed at intervals of $\Delta t$, . . . and to $\theta_{im}$ at $t=t_0+\Delta t(m-1)+kT_{exrf}=t_0+T-\Delta t+kT_{exrf}$. After the lapse of period $T_{exrf}$ with which the phase is changed, the phase $\theta_i$ of each frequency $f_i$ is again changed back to $\theta_{i1}$, and the above phase change is repeated. Similarly, the phase $\theta_j$ of each frequency $f_i$ is changed as shown in FIG. 5. The phase $\theta_j$ to be changed is selected so that the phase difference, $\theta_{ik}-\theta_{jk}$ (where i≠j) between different frequencies $f_i$ and $f_j$ is changed every $\Delta t$. Then, the sum $\Sigma A_i \sin(2\pi f_i t+\theta_i)$of different frequency signals is estimated and applied to the electrodes 25.

When the high frequency signal is applied to the electrodes 25, the orbital gradient to the beam is changed by the effect of the electric and magnetic fields, and starts to increase the betatron oscillation amplitude of the beam. The betatron oscillation amplitude of the particles that exceed the stability limit is rapidly increased by resonance. The particles that have caused resonance in the betatron oscillation, after the oscillation is intensified, are emitted from the beam output device 4. When the betatron oscillation amplitude is changed in this way, difference frequency components are caused between the betatron oscillation frequency $f_\beta$and the externally applied high frequencies, and between these externally applied high frequencies. In other words, if the high frequencies applied to the charge particle beam are represented by $f_1$, $f_2$. . . $f_n$ ($f_1<f_2 \ldots <f_n$), the frequency differences between the betatron oscillation frequency $f_\beta$and the externally applied high frequencies are $f_1-f_\beta$, $f_2-f_\beta$. . . $f_n-f_\beta$. In addition, the maximum frequency difference between the applied high frequencies is $f_n-f_1$, and the minimum one is the lowest frequency of the frequency differences $f_i-f_j$ (i, j: 1, 2 . . . n, and i≠j) between the frequencies $f_1$, $f_2$ . . . $f_n$. These frequency components occur as the betatron oscillation amplitude changing components. In medical accelerator systems, the maximum frequency difference $f_n-f_1$ is about some tens of kHz.

In this embodiment, the phases of the frequency components $f_i-f_\beta$, $f_i-fj$ (i, j=1, 2 . . . n, i≠j) of the betatron oscillation amplitude are also changed at intervals of $\Delta t$ by changing the phases of high frequencies $f_1$, $f_2$ , . . . $f_n$ every At. Therefore, for example, the phases of the frequency components $f_i-f_\beta$, $f_i-fj$ (i, j=1, 2 . . . n, i≠j) of the betatron oscillation amplitude change of the charged particle beam to which the high frequency of the phase $\theta_{i1}$ has been applied at time $t_0+kT_{exrf}$ (k:0, 1, 2 . . . , m) are different from those of the charged particle beam to which the high frequency of the phase $\theta_{i2}$ has been applied at time $t=t_0+\Delta t+kT_{exrf}$ (k:0, 1, 2 . . . , m). As a result of repeating those phase changes, when the charged particle beam of which the betatron oscillation amplitude is slightly smaller than the stability limit passes by the high frequency electrodes at time $t=t_0+kT_{exrf}$, $to=t_0+\Delta t+kT_{exrf}$, $t=t_0+2\Delta t+kT_{exrf}$, . . . $t=t_0+(k-1)\Delta t+kT_{exrf}$ (k:0, 1, 2 . . . , m), it includes a beam that exceeds the stability limit and a beam that does not exceed the stability limit due to the phase difference between the high frequencies. For example, the beam that has passed by the high frequency electrodes at $t=t_0+\Delta t+kT_{exrf}$ is in the phase in which the betatron oscillation amplitude increases, and hence it is emitted, but the beam that has pased by the electrodes at $t=t_0+(k-1)$ At $+kT_{exrt}$ is in the phase in which the amplitude decreases, and hence it is not emitted. In other words, if the beam passes $\Delta t$ early or late by the high frequency electrodes, it will be definitely emitted or not. As time further elapses, the reverse phenomenon occurs. Even though the beam is emitted just $\Delta t$ before, it is not emitted $\Delta t$ after. Therefore, the intensity change of the beam to be emitted is decreased within each of the time intervals from $t=t_0+kT_{exrf}$ to $t=t_0+(k+1)T_{exrf}$, from $t=t_0+(k+1)T_{exrf}$ to $t=t_0+(k+2)T_{exrf}$, and from $t=t_0+(n+2)T_{exrf}$ to $t=t_0+(n+3)T_{exrf}$. Since the change of the instantaneous frequency, or change of phase is performed for each frequency $f_i$ (i=1, 2 . . . n), the change of the frequency components $f_i-f_\beta$, $f_i-fj$ (i, j=1, 2 . . . n i≠j), or some tens of kH or below, of the beam current, with respect to time, is very small.

Referring to FIG. 3, there is shown a computer 133 of the high frequency source 24. This computer 133 computes the high frequency $f_i$ (i=1, 2 . . . n) to be applied for emission, on the basis of the information of beam energy E and cyclic frequency $f_r$ fed from the controller 132 of the accelerator 111 shown in FIG. 1. At the same time, the computer 133 receives from the controller 132 the number m of divisions into which the time T necessary for the charged particle beam once circulate in the cyclic accelerator is divided. Thus, the phase change time $\Delta t$ can be calculated from the expression of $\Delta t=T_{exrf}(=T)/m$. The computer 133 generates data of phase $\theta_{ik}$ (i=1, 2 . . . n ; k=1, 2, . . . m) for frequency $f_i$ (i=1, 2 . . . n) on the basis of the number n of frequency components and the number m of divisions. In this embodiment, the phase $\theta_{ik}$ (i=1, 2 . . . n ; k=1, 2, . . . m) is generated from random numbers that become n when averaged from 0 to 2π. In addition, the sum signal, $\Sigma A_i \sin(2\pi f_i t+\theta_{i1})$ of AC signals of different frequencies is computed over the interval from t=0 to $\Delta t$, where $A_i$ is the amplitude at frequency $f_i$ (i=1, 2, . . . n), and then $\Sigma A_i \sin(2\pi f_i t+\theta_{i2})$ is calculated over the interval from t=$\Delta t$ to $2\Delta t$. These operations are repeated to produce $\Sigma A_i \sin(2\pi f_i t+\theta_{im})$over the interval from t=(m-1) $\Delta t$ to m$\Delta t$. Moreover, $\Sigma A_i \sin(2\pi f_i t+\theta_{i1})$ is computed over the interval from $t=T_{exrf}$ to $\Delta t+T_{exrf}$, $\Sigma A_i \sin(2\pi f_i t+\theta_{i2})$ over the interval from $t=T_{exrf}+\Delta t$ to $T_{exrf}+2\Delta t$, and so on. The results of the computation are stored in a memory 30 for waveform data. The output from the memory 30 is converted to an analog signal by a DA converter 27, amplified by an amplifier 28 and applied via the electrodes 25 to the charged particle beam. The shorter the phase change time $\Delta t$, the more the change of the irradiation beam current with respect time can be reduced. However, it becomes necessary to increase the size of the memory 30 for waveform data, shorten the sampling time in the DA converter 27 and provide a wide frequency band to the amplifier 28 and electrodes 25. Thus, the phase change time $\Delta t$ should be determined by considering these characteristics.

The data to be stored in the memory 30 for waveform data is generated for each beam energy to be emitted. The high frequencies $f_i$ (i=1, 2 . . . n) ranging from frequency $f_1$ to $f_n$ to be applied for emission are confined to within the range from about $f_r/3$ to $(1/3+\delta)$ $f_r$ on the basis of the reciprocal of the period T, or the cyclic frequency $f_r$. The value, $\delta$ is selected to be large enough by considering that the tune is changed due to the momentum difference of the beam. When the charged particle beam is accelerated and produced from the accelerator, waveform data is read from the memory 30 according to the beam energy information from the controller 132, and transmitted to the DA converter 27.

The analog high frequency signal from the DA converter 27 is amplified by the amplifier 28 and applied via the electrodes 25 to the charged particle beam as shown in FIG. 3. When the beam is omitted from the accelerator, the amplification degree of the amplifier 28 is changed by the output from a memory 31 that is controlled by the signal from a controller 134. The patterns of this change with respect to time are also stored in the memory 31 for each beam energy E and for each emission time $T_{ex}$. Thus, changing the high frequencies to be applied to the beam, with respect to time, is made for keeping the number of particles emitted per unit time constant. Just after the start of emission, there are many particles within the stability limit, and as the emission progresses, the number of particles within the stability limit decreases. Since the number of particles emitted per unit time is proportional to the product of the particles within the stability limit and the speed at which the vetatron oscillation exceeds the stability limit, the high frequency voltage to be applied to the beam is increased as the emission progresses, thereby making it possible to maintain the number of particles emitted per unit time constant. Since the beam energy, irradiation dose and irradiation time are determined by information of patient and diseased part, the signal according to that information is sent from the controller 132 to the controller 134, and a proper pattern is read from the memory 31 where data of amplification patters are previously stored, and supplied to the amplifier 28 so that the beam can be emitted.

In this embodiment, the period $T_{exrf}$ with which the phase is changed is the cyclic period T of the charged particle beam, and $\Delta t$ is T divided by a positive integer. Thus, the AC signal to be applied to the charged particle beam from the high frequency source 24 includes not only a frequency range from $f_1$ to $f_n$, but also the equal-bandwidth frequency ranges from $f_r+f_1$ to $f_r+f_n$, from $2f_r+f_1$ to $2f_r+f_n$, from $3f_r+f_1$ to $3f_r+f_n$, . . . shifted by $f_r$ from band to band. These frequency components extend to about $1/(2\Delta t)$, maximum. Therefore, the range of the frequency components to be applied to the charged particle beam is substantially equal to an integral multiple of the cyclic frequency +the betatron oscillation frequency so that the betatron oscillation amplitude can be effectively increased. Accordingly, the amplifier 28 of the high frequency source 24 and the electrodes 25 are required to have such wide-band frequency characteristics that these high frequencies can be all applied to the charged particle beam without attenuation. If the division number m and At are respectively made large and small, higher frequency components will be caused, and hence it will be necessary to improve the characteristics of the amplifier 28 and the electrodes 25 according to the higher frequency components.

The period $T_{exrf}$ with which the phase is changed should be selected to be about the cyclic period T $(=1/f_r)$ of the charged particle beam or a period corresponding to the frequency components that are important in the change of beam emission current with respect to time, or to some tens of kHz, namely to be about dozens of $\mu$s. The reason for this is that if the phase is changed in the other periods, the high frequency components to be applied to the charged particle beam include components that cannot effectively increase the betatron oscillation amplitude, thus preventing the power of the high frequency source from being effectively used. When $T_{exrf}$=T (the cyclic period of the charged particle beam), the high frequency spectrum generated from the high frequency source 24, since the instantaneous frequency is changed with respect to time, extends not only to a range from $f_1$ to $f_n$, but also to the ranges about from $f_r+f_1$ to $f_r+f_n$, $2f_r+f_1$ to $2f_r+f_n$, . . . , from $6f_r+f_1$ to $6f_r+f_n$. Here, $f_r$ is the cyclic frequency of the charged particle beam, and is the reciprocal of the period T with which the instantaneous frequency is changed. The amplifier 28 of the high frequency source 24 and the electrodes 25 need to have frequency characteristics wide enough to make it possible to apply these high frequencies to the charged particle beam without attenuation. If the division number m and $\Delta t$ are respectively large and small, higher frequency components are caused, and thus it is necessary to use the amplifier 28 and the electrodes 25 capable of handling such higher frequency components.

When the period $T_{exrf}$ with which the phase is changed is selected to be about 50 $\mu$s corresponding to the frequency (dozens of kHz) for suppressing the emission beam current from changing with respect to time, the lowest frequency of the high frequency spectrum generated from the high frequency source 24 is lowered about a few times as much as dozens of kHz than the frequency $f_1$, while the highest frequency thereof is raised similarly about a few times as much as dozens of kHz than the frequency $f_n$. Thus, the efficiency of the high frequency power for changing the betatron oscillation amplitude is slightly reduced. However, such higher frequency components as the ranges from $f_r+f_1$ to $f_r+f_n$ and from $2f_r+f_1$ to $2f_r+f_n$ caused when $T_{exrf}$=T are not produced. Therefore, the amplifier 28 of the high frequency source 24 and the electrodes 25 do not need a wide frequency band that is necessary when the phase change period $T_{exrf}$ is selected to be the cyclic period T of the charged particle beam.

The beam produced from the accelerator 111 and transported via the transport system 102 to the treatment room 98 is irradiated on patient by a rotary irradiator 110. The transport system 102 has a monitor 32 provided to measure the beam current or the amount of radiation substantially proportional to the beam current. A comparator 34 shown in FIG. 3 compares the output from this monitor 32 and a target value 33 of beam current that is transmitted from the controller 132 via the computer 133. The amplifier 28 of the high frequency source 24 is controlled on the basis of the difference from the comparator, thus controlling the high frequency power to be applied to the charged particle beam so that a target beam current can be produced. The signal produced from the comparator 34 in order to control the amplifier 28 acts to increase or decrease the amplification degree of the amplifier 28 in accordance with the difference between the measured value and target value of the irradiation current. If there are cases in which the beam energy E differs even under the same difference between the measured value and the target value, the amount of increasing or decreasing the amplification degree is changed according to the beam energy E fed from the computer 133. Thus, according to the present invention, the change of the beam current generated by the high frequencies for emission with respect to time is reduced by changing the phases of the high frequencies, or the instantaneous frequency with respect to time, and the change of the current due to the other causes is solved by the above-mentioned control, thereby making the current be kept constant.

The rotary irradiator 110 provided in the treatment room 98 will be described below. The rotary irradiator 110 can irradiate the beam on patient from any angle by the rotating axis as shown in FIG. 1. The rotary irradiator has the four-pole electromagnets 104 and deflection electromagnets 105 for transporting the beam produced from the accelerator 111 to the object to be irradiated, and the power supply 112 for supplying current to the four-pole electromagnets 104 and deflection electromagnets 105.

Figure 2:
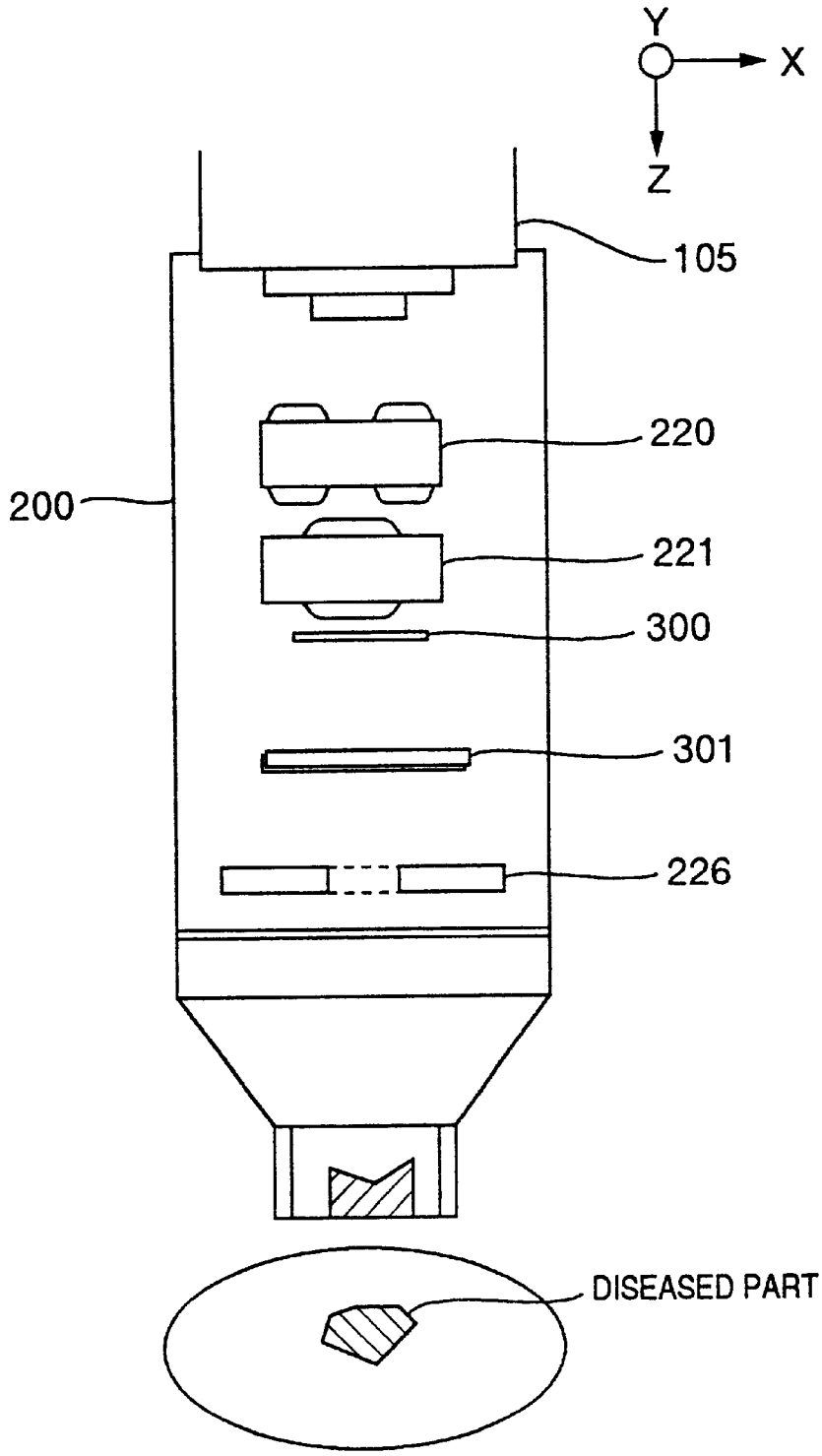
FIG. 2 is a diagram of irradiation nozzle 200 in FIG. 1.

The rotary irradiator 110 also has the irradiation nozzle 200. The nozzle 200 has electromagnets 220, 221 for moving the irradiation nozzle in the x-direction and y-direction. Here, the x-direction is the direction parallel to the deflecting plane of the deflection electromagnet 105, and y-direction the direction perpendicular to the deflecting plane of the deflection electromagnet 105. The power supply 201 for supplying current is connected to the electromagnets 220, 221. FIG. 2 shows the irradiation nozzle 200. A scatterer 300 for increasing the beam diameter is provided below the electromagnets 220, 221. An irradiation amount monitor 301 for measuring the irradiation amount distribution of the beam is also provided below the scatterer 300. Moreover, a collimator 226 is provided just before patient as an object to be irradiated in order to prevent the damage to the sound cells around the affected part.

Figure 6A:
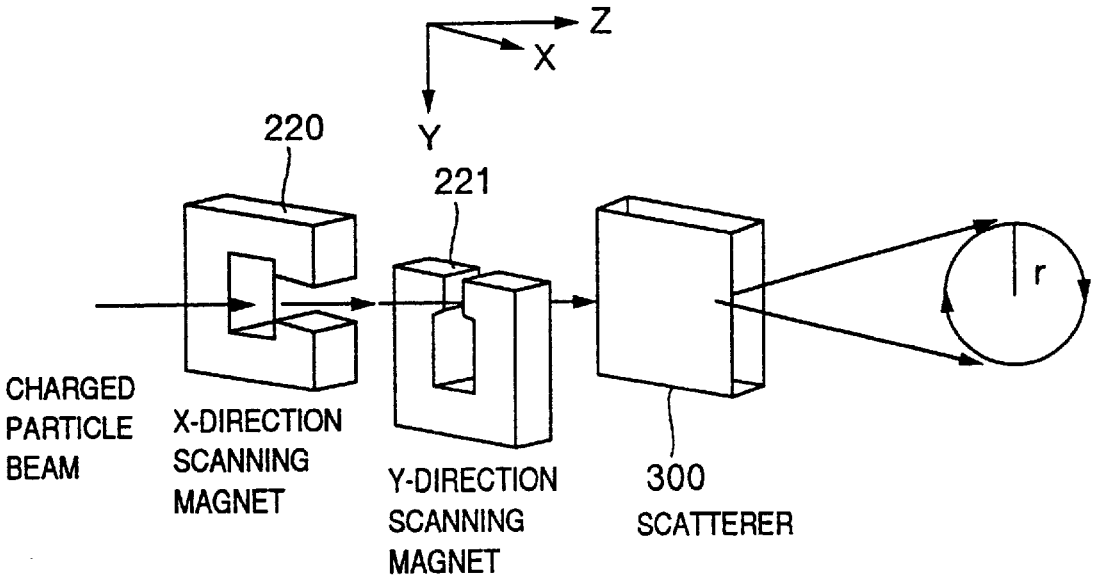
FIGS. 6A and 6B are diagrams showing an irradiation method using a scatterer, and the intensity distribution of radiation.
Figure 6B:
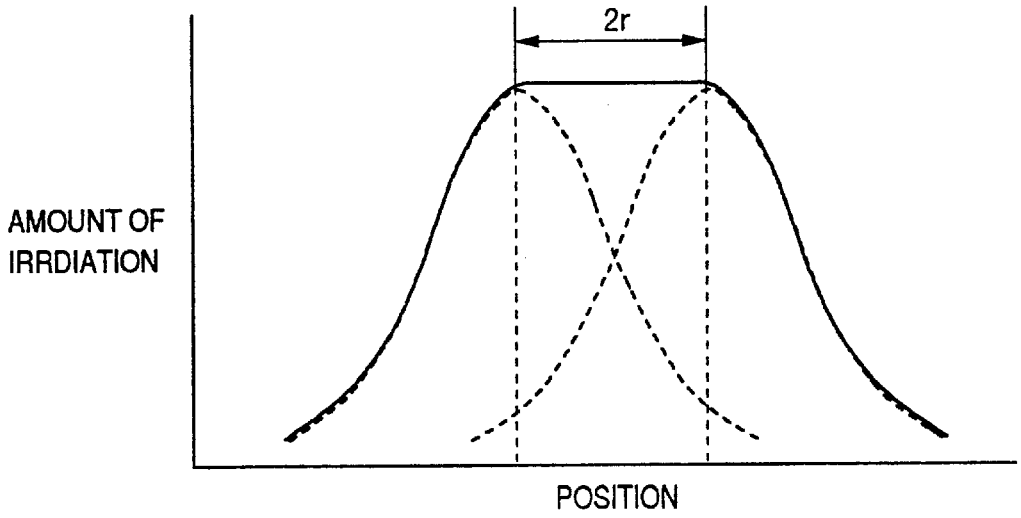

FIGS. 6A and 6B show the beam magnified by the scatterer 300, and its intensity distribution. The beam expanded by the scatterer takes substantially Gaussian distribution, and is deflected by the electromagnets 220, 221 so as to circularly scan. The radius r of the scanning circle is selected to be about 1.1 to 1.2 times as large as the diameter of the charged particle beam expanded by the scatterer. The result is that the charged particle beam portion irradiated inside the circular track of the scanning center takes a flat integration intensity distribution. Therefore, the treatment plan apparatus 131 is used to previously fix the irradiation position ($X_i$, $Y_i$) (i=1, 2, . . . n) of the beam, and a necessary irradiation dose, and after the irradiation, the fact that the beam of the necessary dose has been irradiated is confirmed by the irradiation amount monitor 301. Then, the irradiation position is changed, and the irradiation procedure is repeated, thus making it possible to uniformly irradiate the beam on the diseased part.

If patient's body is moved because of breath or other factors, a signal indicative of the movement of the patient's body is sent to control, the charged particle beam to be urgently stopped from irradiation. In this case, an urgent stop signal is sent from the irradiation system, and further a dose expiration signal is sent when the dose meter of the irradiation system detects that the beam of the target dose has been irradiated. On the basis of these signals an interruption generator 35 provided in the high frequency source 24 sends a control signal for stopping the high frequencies, to the controller 134, and a high frequency switch 36 provided in the high frequency source 24 stops the high frequencies from being applied to the electrodes 25. Thus, by stopping the high frequencies from the high frequency source 24, it is possible to suspend the irradiation of the charged particle beam in a short time. In addition, a plurality of high frequency stopping means can be provided within the high frequency source 24, thereby making it possible to more surely stop the irradiation of the beam.

Embodiment 2

The second embodiment of the invention will be described.

The system of the second embodiment has the same construction as that of the first embodiment. In the high frequency source 24 shown in FIG. 3, the computer 33 generates the high frequency signal expressed by the sum signal, $\Sigma A_i \sin(2\pi f_i t + B_i \sin(2\pi t/T_{exrf} + \phi_i))$ of signals of different frequencies $f_i$ where t is time, $f_r$ is the cyclic frequency of the beam, $f_i$ is the frequencies of signals (i=1, 2, . . . n), $\phi_i$ is the phase of each frequency $f_i$, $A_i$ is the amplitude, and $B_i$ is constant. The data of this high frequency signal is stored in the memory 30. In this high frequency signal, the phase is changed with period $T_{exrf}$, thus changing the instantaneous frequency of the signal as in the first embodiment 1. When the beam is irradiated, the data is read from the memory 30 and sent to the DA converter 27 where it is converted to an analog signal. The analog signal is amplified by the amplifier 28, and applied via the electrodes 25 to the beam. The way that a plurality of frequencies $f_i$ (i=1, 2, . . . n) are selected is exactly the same as in the embodiment 1. The n phases $\phi_i$ (i=1, 2, . . . n) are selected from random numbers of average $\pi$ ranging from 0 to $2\pi$. The constant $B_i$ should be selected to be large, or $2\pi$ in this embodiment.

When $T_{exrf}$ is selected to be period T with which the beam circulates, the signal of $A_i \sin(2\pi f_i t + 2\pi \sin(2\pi t/T_{exrf} + \phi_i))$ has the frequency spectrum of $L/T_{exrf} \pm f_i = L \cdot f_r \pm f_i$ (L=1, 2 . . . , an integer close to $B_i$). In other words, the frequency spectrum is separated by an integral multiple of cyclic frequency $f_r$ from the original $f_i$. Although the speed at which the betatron oscillation amplitude of the beam is increased is not reduced, it is necessary that the amplifier 28 and the electrodes 25 have such frequency characteristics as not to attenuate these frequency components as in the embodiment 1.

Figure 7:
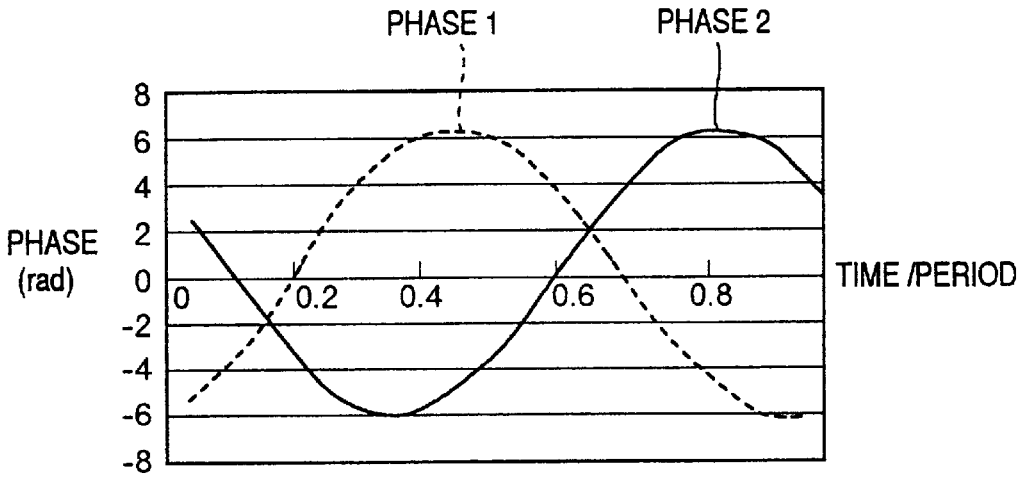
FIG. 7 is a graph showing the change of phase of a high-frequency signal in a medical accelerator system of another embodiment according to the invention.
Figure 8:
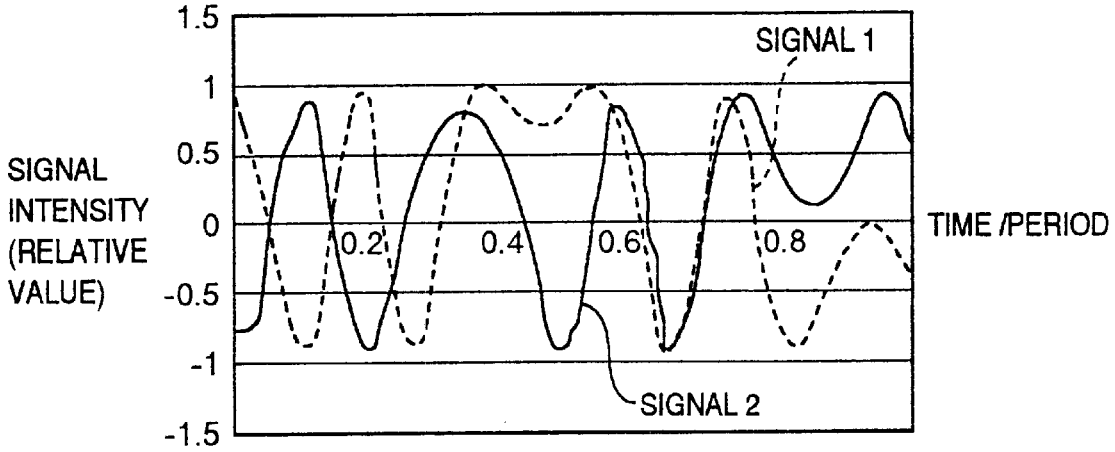
FIG. 8 is a graph showing the change of signal intensity of a high-frequency signal in a medical accelerator system of another embodiment according to the invention.

When $T_{exrf}$ is selected to be about 50 $\mu$s, or $1/T_{exrf}$ to be about 20 kHz, the signal of $A_i \sin(2\pi f_i t + 2\pi \sin(2\pi t/T_{exrf} + \phi_i))$ has the frequency spectrum of $L/T_{exrf} \pm f_i = L \cdot f_r \pm f_i$ (L=1, 2 . . . , an integer close to $B_i$). In other words, the frequency spectrum is extended by an integral multiple of 20 kHz from the original $f_i$, and the speed of the increase of the betatron oscillation amplitude of the beam is lowered. The phases, $2\pi \sin(2\pi f_r t + \phi_1)$ and $2\pi \sin(2\pi f_r t + \phi_2)$ that change the instantaneous frequency of the signal, $\sin(2\pi f_i t + 2\pi \sin(2\pi f_r t + \phi_i))$ (i=1, 2, . . . n) where $T_{exrf}$=T are shown as phase 1 and phase 2 in FIG. 7. In addition, FIG. 8 shows the intensity changes of a signal 1=$\sin(2\pi f_i t + 2\pi \sin(2\pi f_r t + \phi_1)$ and a signal 2=$\sin(2\pi f_2 t + 2\pi \sin(2\pi f_r t + \phi_2)$ associated with the phases 1, 2. The abscissas in FIGS. 7 and 8 are based on the cyclic period T of the beam. From these figures, it will be seen that the phases of the high frequency signals to be applied to the beam change with the change of the circulation position of the beam, and hence that the phase of change of the betatron oscillation amplitude changes with the change of the circulation position.

Figure 9:
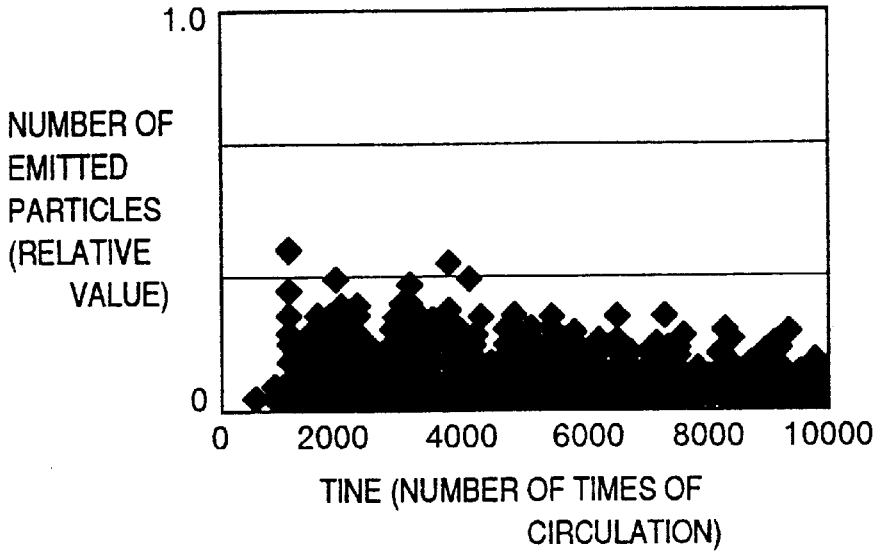
FIG. 9 is a diagram showing the result of numeric simulation of the intensity change of charged particle beam in the embodiments of FIGS. 7 and 8.
Figure 10:
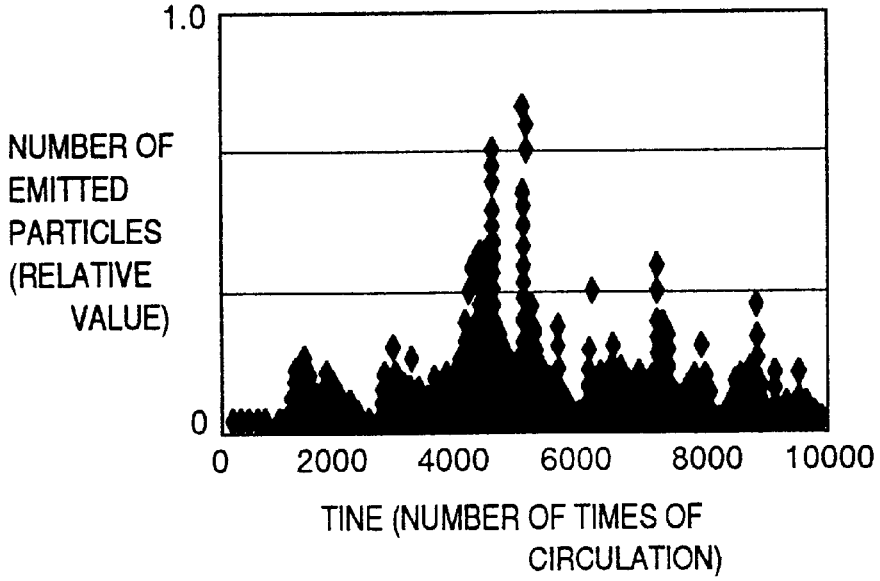
FIG. 10 is a diagram showing the result of numeric simulation of the intensity change of charged particle beam in the prior art.

FIG. 9 shows the numerical simulation results of the intensity change of the charged particle beam emitted when the high frequencies of this embodiment are applied to the beam. In addition, FIG. 10 shows the numerical simulation results of the intensity change of the beam in the prior art with the phases of the high frequencies for emission maintained constant. The abscissas in FIGS. 9 and 10 are the number of times of circulation, or time, and the ordinates are the relative values of emitted particle numbers. From the figures, it will be apparent that the number of emitted particles in this invention can be maintained constant more effectively. That is, in the prior art, since the instantaneous frequency of AC signal of frequency $f_i$ is constant with the phase not changed, the phase of the increase of the betatron oscillation amplitude does not depend on the circulation position. Therefore, when the beam is emitted, the beam from the head to the latter half in the circulation direction is emitted. On the contrary, when the beam is not emitted, the beam from the head to the latter half in the circulation direction is not irradiated. Thus, the frequency components $f_i-f_\beta$, $f_i-f_j$ have clearly occurred in the intensity change of the emitted beam with respect to time.

Embodiment 3

The third embodiment of the invention will be described.

Figure 11:
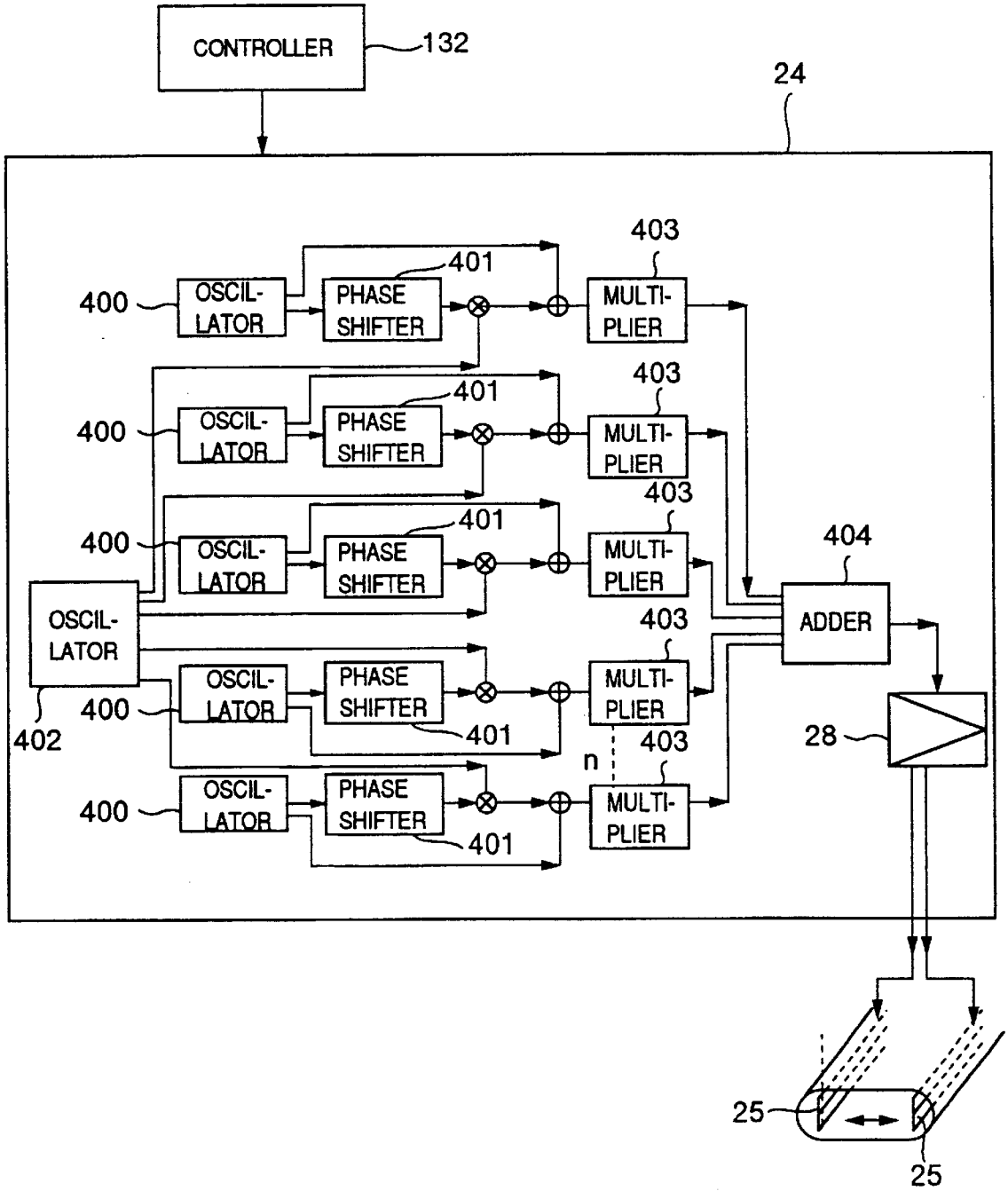
FIG. 11 is a block diagram of high frequency source 24 of a medical accelerator system of another embodiment according to the invention.

The construction of this embodiment is the same as those of the first and second embodiments except for the construction of the high frequency source. FIG. 11 shows the high frequency source 24 of this embodiment. The high frequency source 24 of this embodiment employs n oscillators 400 of frequencies $f_i/k$ (i=1, 2, . . . n), where k is an integer large enough. The signals from the oscillators 400 of frequencies $f_i/k$ are shifted 90 degrees in phase by phase shifters 401. If the signal from the oscillator 400 of frequency $f_1/k$ is represented by $\sin(2\pi(f_i/k)t)$, the 90-degree shifted signal can be represented by $\cos(2\pi(f_i/k)t)$. An oscillator 402 is used to generate a signal, $2\pi \sin(2\pi t/T_{exrf}+\phi_i)/k$ for making a product signal, where $T_{exrf}$ is the same value as in the embodiments 1, 2, or the period with which the phase is changed, and $\phi_i$ is the phase. The signal, $\cos(2\pi(f_i/k)t)$ is multiplied by the signal, $2\pi \sin(2\pi t/T_{exrf}+\phi_i)/k$ to produce the product signal, $2\pi \sin(2\pi t/T_{exrf}+\phi_i)\cdot\cos(2\pi(f_i/k)t)/k$. When the product signal is added to $\sin(2\pi(f_i/k)t)$, the signal, $\sin(2\pi(f_i/k)t+2\pi \sin(2\pi t/T_{exrf}+\phi_i)\cdot\cos(2\pi(f_i/k)t)/k$ is produced. This added product signal, if considering that $2\pi/k$ is small enough, can be expressed by $\sin(2\pi(f_i/k)t+2\pi \sin(2\pi t/T_{exrf}+\phi_i)/k)$. Therefore, when this signal is supplied to a multiplier 403 for multiplying the frequency by k, the output, $\sin(2\pi f_i t+2\pi \sin(2\pi t/T_{exrf}+\phi_i))$ can be produced from the multiplier. The outputs from the oscillators 400 of frequencies $f_i/k$ (i=1, 2, . . . n) are processed in exactly the same way as above, and the outputs from the multipliers 403 are finally added by an adder 404 to produce the signal, $\Sigma A_i \sin(2\pi f_i t+2\pi \sin(2\pi t/T_{exrf}+\phi_i))$, where $T_{exrf}$ is called cyclic period T of the charged particle beam or may be selected to be about 50 $\mu$s as in the embodiments 1, 2. The output from the adder 404 is amplified by the amplifier 28, and then applied to the electrodes 25, thereby obtaining the same effect as in the embodiments 1, 2. This embodiment can be constructed by analog circuit elements, and thus has the advantage that it does not need the conditions for the memory size and sampling time of DA converter that are necessary in the embodiments 1, 2 of digital circuits. The frequency characteristics of the amplifier 28 and electrodes 25 are required to be the same as in the embodiments 1, 2.

Embodiment 4

The fourth embodiment of the invention will be described.

Figure 12:
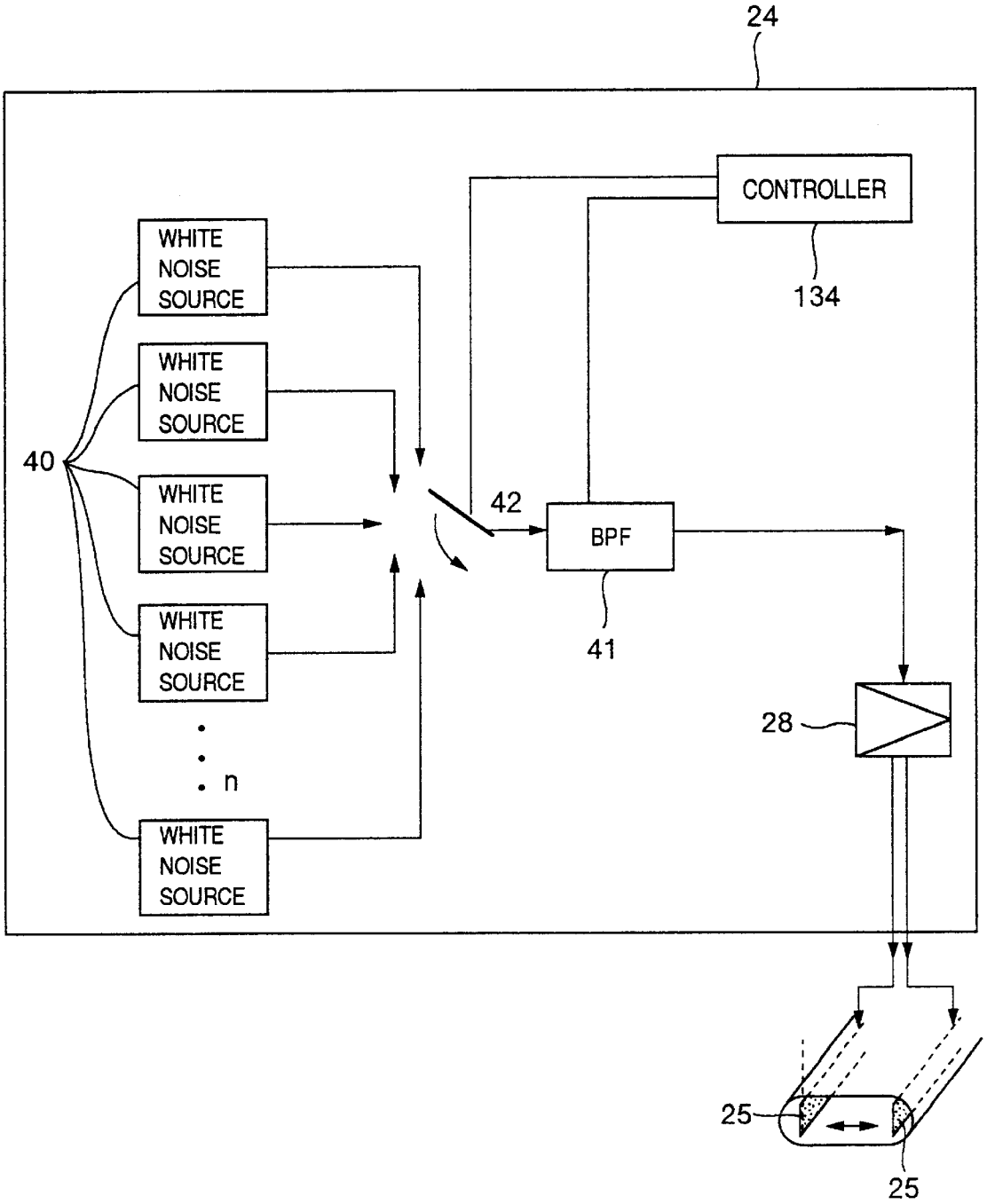
FIG. 12 is a block diagram of high frequency source 24 of a medical accelerator system of another embodiment according to the invention.

The construction of this embodiment is the same as those in the embodiments 1, 2 except for the construction of the high frequency source. FIG. 12 shows the high frequency source 24 of this embodiment. The high frequency source 24 of this embodiment employs m different white noise sources 40. The output from each of the white noise sources 40 is supplied to a band-pass filter 41, and this band-pass filter produces a high frequency continuous spectrum ranging from the lowest frequency $f_1$ to the highest frequency $f_n$. The outputs from the m different white noise sources 40 have the same frequency spectrum, but different phases in their frequency bands. In this embodiment, the outputs from the m different white noise sources 40 are switched by a switch 42 at each time $\Delta t$ (=T/m) in response to the signal from the controller 134, and the selected output is amplified by the amplifier 28 up to a necessary voltage, and applied via the electrodes 25 to the charged particle beam. Since the same frequencies as in the embodiment 1 are required to be applied to the beam, the band-pass filter 41 has the pass bands from $f_1$ to $f_n$, from $f_r+f_1$ to $f_r+f_n$, from $2f_r+f_1$ to $2f_r+f_n$, . . . , $6f_r+f_1$ to $6f_r+f_n$ which are changed according to the energy and tune of the charged particle beam sent from the controller 134.

In the high frequency source 24 of this embodiment, the phase of each high frequency to be applied to the beam is changed with respect to time by selecting one of the different white noise sources 40 in turn. In other words, the same action as in the embodiment can be exerted on the beam. In this embodiment, the high frequency source having the same action as in the embodiment 1 can be produced without using any memory and DA converter.

Thus, it is possible to provide an accelerator capable of emitting the charged particle beam of which the intensity is less changed with respect to time. Moreover, in a medical accelerator system in which the charged particle beam produced from an accelerator is transported to an irradiator, and irradiated therefrom for treatment, the diseased part can be uniformly irradiated. In addition, contrarily, the amount of irradiation can be easily controlled to change relative to position. Furthermore, the time resolution that the beam monitor needs for the control of the amount of irradiation can be reduced, thus making it possible to simplify the beam monitor and its control system.

What is claimed is:

1. A cyclic type accelerator comprising:

deflection electromagnets and four-pole electromagnets for making a charged particle beam circulate;

a multi-pole electromagnet for generating a stability limit of resonance of betatron oscillation for emission of said charged particle beam; and a high frequency source for applying a high frequency electromagnetic field to said beam to move said beam to the outside of said stability limit, thus exciting resonance in said betatron oscillation, characterized in that, in order to-apply a high frequency electromagnetic field to said beam to move said beam to the outside of said stability limit, said high frequency source generates an AC signal including a plurality of frequency components, between which the minimum frequency difference is in the range from 500 Hz to 10 kHz inclusive, and the phase of the plurality of frequency components is adjusted so that the phase difference between each frequency components take the values other than an integer×π.

2. A cyclic type accelerator comprising:

deflection electromagnets and four-pole electromagnets for making a charged particle beam circulate;

a multi-pole electromagnet for generating a stability limit of resonance of betatron oscillation for emission of said charged particle beam; and a high frequency source for applying a high frequency electromagnetic field to said beam to move said beam to the outside of said stability limit, thus exciting resonance in said betatron oscillation, characterized in that said high frequency source generates a sum signal of a plurality of signals of which the instantaneous frequencies change with respect to time, and of which the average values of said instantaneous frequencies with respect to time are different, and applies said sum signal to said beam.

3. A cyclic type accelerator comprising:

deflection electromagnets and four-pole electromagnets for making a charged particle beam circulate;

a multi-pole electromagnet for generating a stability limit of resonance of betatron oscillation for emission of said charged particle beam; and a high frequency source for applying a high frequency electromagnetic field to said beam to move said beam to the outside of said stability limit, thus exciting resonance in said betatron oscillation, characterized in that said high frequency source generates a sum signal of a plurality of signals of which the instantaneous frequencies change with respect to time, and of which the average values of said instantaneous frequencies with respect to time and values changing with respect to time are different, and applies said sum signal to said beam.

4. A cyclic type accelerator comprising:

deflection electromagnets and four-pole electromagnets for making a charged particle beam circulate;

a multi-pole electromagnet for generating a stability limit of resonance of betatron oscillation for emission of said charged particle beam; and a high frequency source for applying a high frequency electromagnetic field to said beam to move said beam to the outside of said stability limit, thus exciting resonance in said betatron oscillation, characterized in that said high frequency source generates a sum signal, $\Sigma A_i \sin(2\pi f_i t+\theta_i(t))$ where t is time, of a plurality of AC signals, $A_i \sin(2\pi f_i t+\theta_i(t))$ that have different frequencies $f_i$ (i=1, 2 . . . n), signals $\theta_i(t)$ associated with the frequencies $f_i$ and changing with a predetermined period with respect to time, and amplitudes $A_i$ associated with the frequencies $f_i$.

5. A cyclic type accelerator comprising:

deflection electromagnets and four-pole electromagnets for making a charged particle beam circulate;

a multi-pole electromagnet for generating a stability limit of resonance of betatron oscillation for emission of said charged particle beam; and a high frequency source for applying a high frequency electromagnetic field to said beam to move said beam to the outside of said stability limit, thus exciting resonance in said betatron oscillation, characterized in that said high frequency source has a plurality of thermal noise generators, switching means for selecting one of said plurality of thermal noise generators so that the output from said selected thermal noise generator can be applied to said beam, and control means for controlling said switching means to switch said thermal noise generators, thereby selecting a proper one in the course of beam emission.

6. A medical accelerator system comprising:

a cyclic type accelerator having deflection electromagnets and four-pole electromagnets for making a charged particle beam circulate, a multi-pole electromagnet for generating a stability limit of resonance of betatron oscillation for emission of said charged particle beam, and a high frequency source for applying a high frequency electromagnetic field to said beam to move said beam to the outside of said stability limit, thus exciting resonance in said betatron oscillation;

a transport system for transporting said beam produced from said cyclic type accelerator; and an irradiator for irradiating said transported beam on patient, characterized in that, in order to apply a high frequency electromagnetic field to said beam to move said beam to the outside of said stability limit, said high frequency source generates an AC signal including a plurality of frequency components, between which the minimum frequency difference is in the range from 500 Hz to 10 kHz inclusive, and the phase of the plurality frequency components is adjusted so that the phase difference between each frequency components take the values other than an integer×π.

7. A medical accelerator system comprising:

a cyclic type accelerator having deflection electromagnets and four-pole electromagnets for making a charged particle beam circulate, a multi-pole electromagnet for generating a stability limit of resonance of betatron oscillation for emission of said charged particle beam, and a high frequency source for applying a high frequency electromagnetic field to said beam to move said beam to the outside of said stability limit, thus exciting resonance in said betatron oscillation;

a transport system for transporting said beam produced from said cyclic type accelerator; and an irradiator for irradiating said transported beam on patient, characterized in that said high frequency source generates a sum signal of a plurality of signals of which the instantaneous frequencies change with respect to time, and of which the average values of said instantaneous frequencies with respect to time are different, and applies said sum signal to said beam.

8. A medical accelerator system comprising:

a cyclic type accelerator having deflection electromagnets and four-pole electromagnets for making a charged particle beam circulate, a multi-pole electromagnet for generating a stability limit of resonance of betatron oscillation for emission of said charged particle beam, and a high frequency source for applying a high frequency electromagnetic field to said beam to move said beam to the outside of said stability limit, thus exciting resonance in said betatron oscillation;

a transport system for transporting said beam produced from said cyclic type accelerator; and an irradiator for irradiating said transported beam on patient, characterized in that said high frequency source generates a sum signal, $\Sigma A_i \sin(2\pi f_i t+\theta_i)$where t is time, of a plurality of AC signals that have different frequencies $f_i$ (i=1, 2 . . . n), and phases $\theta_i$ and amplitudes $A_i$ associated with the frequencies $f_i$, said phases $\theta_i$ changing with a predetermined period with respect to time.

9. A method of operating a medical accelerator system that has a cyclic type accelerator including deflection electromagnets and four-pole electromagnets for making a charged particle beam circulate, a multi-pole electromagnet for generating a stability limit of resonance of betatron oscillation for emission of said charged particle beam, and a high frequency source for applying a high frequency electromagnetic field to said beam to move said beam to the outside of said stability limit, thus exciting resonance in said betatron oscillation; a transport system for transporting said beam produced from said cyclic type accelerator; and an irradiator for irradiating said transported beam on patient, said method comprising the steps of:

generating from said high frequency source an AC signal including a plurality of frequency components, between which the minimum frequency difference is in the range from 500 Hz to 10 kHz inclusive, and the phase of the plurality of frequency components is adjusted so that the phase difference between each frequency components take values other than an integer×π;

applying a high frequency electromagnetic field based on said AC signal to said beam so that said beam can be moved to the outside of said stability limit and produced from said cyclic type accelerator;

transporting said produced beam by said transport system; and irradiating said beam from said irradiator.

10. A method of operating a medical accelerator system that has a cyclic type accelerator including deflection electromagnets and four-pole electromagnets for making a charged particle beam circulate, a multi-pole electromagnet for generating a stability limit of resonance of betatron oscillation for emission of said charged particle beam, and a high frequency source for applying a high frequency electromagnetic field to said beam to move said beam to the outside of said stability limit, thus exciting resonance in said betatron oscillation; a transport system for transporting said beam produced from said cyclic type accelerator; and an irradiator for irradiating said transported beam on patient, said method comprising the steps of:

generating from said high frequency source a sum signal of a plurality of signals of which the instantaneous frequencies change with respect to time, and of which the average values of said instantaneous frequencies with respect to time are different;

applying said sum signal to said beam so that said beam can be produced from said cyclic type accelerator;

transporting said produced beam by said transport system; and irradiating said beam from said irradiator.

11. A method of operating a medical accelerator system that has a cyclic type accelerator including deflection electromagnets and four-pole electromagnets for making a charged particle beam circulate, a multi-pole electromagnet for generating a stability limit of resonance of betatron oscillation for emission of said charged particle beam, and a high frequency source for applying a high frequency electromagnetic field to said beam to move said beam to the outside of said stability limit, thus exciting resonance in said betatron oscillation; a transport system for transporting said beam produced from said cyclic type accelerator; and an irradiator for irradiating said transported beam on patient, said method comprising the steps of:

applying to said beam a sum signal, $\Sigma A_i \sin(2\pi f_i t+\theta_i)$ where t is time, of a plurality of AC signals that have different high frequencies $f_i$ (i=1, 2 . . . n), and phases $\theta_i$ and amplitudes $A_i$ associated with the frequencies $f_i$, said phases $\theta_i$ changing with a predetermined period with respect to time;

transporting said beam produced from said accelerator by applying said high frequency signal to said beam; and irradiating said beam from said irradiator.

* * * * *